US006169373B1

(12) United States Patent
Riesinger

(10) Patent No.: US 6,169,373 B1
(45) Date of Patent: Jan. 2, 2001

(54) WORK LIGHT

(76) Inventor: Josef Riesinger, Katharina-Eberhardstrasse 4, D-85540 Haar (DE)

( * ) Notice: Under 35 U.S.C. 154(b), the term of this patent shall be extended for 0 days.

(21) Appl. No.: 09/099,535

(22) Filed: Jun. 18, 1998

(30) Foreign Application Priority Data

Dec. 11, 1997 (DE) ..... 297 21 928 U
Jan. 27, 1998 (DE) ..... 198 02 998

(51) Int. Cl.[7] ..... H05B 37/00

(52) U.S. Cl. ..... 315/200 A; 315/178; 315/307; 315/312; 362/218; 362/109

(58) Field of Search ..... 315/178, 179, 315/180, 182, 183, 312, 307, 313, 200 A, 58; 362/218, 109

(56) References Cited

U.S. PATENT DOCUMENTS

| | | | | |
|---|---|---|---|---|
| 3,629,600 | * | 12/1971 | Stuler | 307/66 |
| 3,922,582 | * | 11/1975 | Pitel | 315/106 |
| 3,953,768 | * | 4/1976 | Meredith et al. | 317/31 |
| 4,204,139 | * | 5/1980 | Shimer et al. | 315/58 |
| 4,211,958 | * | 7/1980 | Bickford et al. | 315/312 |
| 4,218,637 | * | 8/1980 | Zelina, Jr. | 315/313 |
| 4,432,043 | * | 2/1984 | Yuen | 362/184 |
| 5,003,437 | * | 3/1991 | Barrett | 362/109 |
| 5,039,921 | * | 8/1991 | Kakitani | 315/307 |
| 5,404,082 | * | 4/1995 | Hernandez et al. | 315/219 |
| 5,583,399 | * | 12/1996 | Rudolph | 315/291 |
| 5,685,586 | * | 11/1997 | Miller | 294/24 |

FOREIGN PATENT DOCUMENTS

| | | |
|---|---|---|
| 2062780 | 9/1990 | (CN) . |
| 7245444 | 12/1972 | (DE) . |
| 7636613 | 3/1977 | (DE) . |
| 7706075 | 4/1978 | (DE) . |
| 8709307 | 7/1987 | (DE) . |
| 8802376 | 2/1988 | (DE) . |
| 8913895 | 11/1989 | (DE) . |
| 9014588 | 10/1990 | (DE) . |
| 4036632 | 11/1990 | (DE) . |
| 296 21 474 U | 12/1996 | (DE) . |
| 042362 | 6/1981 | (EP) . |
| 2112513 | 12/1981 | (GB) . |

* cited by examiner

*Primary Examiner*—Don Wong
*Assistant Examiner*—Tuyet T. Vo
(74) *Attorney, Agent, or Firm*—Dennison, Scheiner, Schultz & Wakeman

(57) ABSTRACT

A work light includes a generally cylindrical, at least partly transparent housing, a first light source which is an elongated, rodlike bulb disposed within the housing, a second light source which is a narrow beam bulb disposed within the housing at one end face thereof, a connection of the first light source to an alternating current electrical main and a hangar hook projecting externally from the housing. Circuitry is also provided for converting alternating current of a first frequency from the main into direct current, for converting the direct current into alternating current of a second frequency substantially higher than the first frequency, and for selectively operating the first light source and the second light source with the alternating current of a second frequency.

13 Claims, 4 Drawing Sheets

WORK LIGHT

BACKGROUND OF THE INVENTION

The invention relates to a rodlike work light, with a rodlike bulb for the main circuit connection; a cylindrical, at least partly transparent housing surrounding the rodlike bulb; an electrical connection cable connected to the rodlike bulb; and a hangar hook.

Rodlike work lights of this kind with wide-area illumination of the work field (see for instance German Utility Model DE-U 77 06 075) are used in great numbers for instance in motor vehicle repair work, and installation work in buildings, etc., where a sufficiently bright, uniform lighting of a large area is important. Typically, the rodlike bulbs used in them are fluorescent tubes, which provide the requisite light yield or brightness for the mechanical or monitoring work. For the sake of positional fixation and for reasons of manipulation, these work lights are often provided with hangar hooks from which they are hung up.

The work lights are intended for main circuit connection, because the work typically lasts relatively long and battery consumption entails environmental problems and is expensive. The need to recharge excessively often argues against the use of a rechargeable battery.

In installation and mechanical work such as that mentioned above, broad illumination of the work area is indeed indispensable. Often, such illumination is inadequate. In tight places where it is hard to see, the glare produced by such rodlike bulbs is a hindrance, yet direct illumination of a selective work field in this case is inadequate. For illuminating such a selective, narrow work field, a narrow-beam light source is needed as well. Until now, in such cases, mechanics have used a flashlight. But first, they must have one available, and second, using a flashlight means they cannot work with both hands.

Lights that use combinations of light sources are already known as well. These are battery-operated lights meant to be carried in motor vehicles, which in a first switching position function as a suitably colored blinking warning light. In a second switching position, they function as a handheld light, or a light on a stand, with a white-light source. Because of their size, they can hardly be used for the aforementioned purpose as a work light. The disadvantages of using batteries for this purpose have already been noted above.

From British Patent GB-A 2 112 513, a portable light with a fluorescent bulb and an incandescent bulb that are reversibly combined with one another in one housing is known. For the sake of commonly supplying voltage to the two bulbs, a set of batteries is provided which can be inserted into the bulb housing. The incandescent bulb is supplied directly from the battery via a reversing switch. The fluorescent bulb, conversely, is supplied from an electronic circuit which converts the direct voltage into a suitable alternating voltage. The known handheld work light has two substantial disadvantages: First, because of the batteries accommodated in the housing, it has a relatively high weight, which can cause fatigue when held in the hand for a long time. Second, because of the battery supply, the operating time is limited, while if the light is used frequently the batteries have to be replaced relatively often. Moreover, the batteries occupy a relatively large space, which increases the external dimensions of the light. Finally, for the narrow-beam illumination, it is desirable to use a stronger light source instead of the incandescent bulb.

Another battery-operated light with combined light sources is described in German Patent Disclosure DE-A 40 36 632. This light contains a rodlike light source in a first housing part, batteries in a second housing part, and an incandescent bulb with a reflector in a third housing part. By swiveling the first housing part, the light can be used either as a table light with a rodlike light source or as a flashlight with an incandescent bulb and reflector. Such a light cannot be used as a work light for mechanical work.

SUMMARY OF THE INVENTION

The object of the invention is to create a rodlike work light which enables not only wide-area illumination but also the illumination of a selective work field, which is easy to handle in terms of its size and weight, and is suitable for long-term operation.

Thus a work light according to the invention includes a rodlike bulb for the main circuit connection and a cylindrical, at least partly transparent housing surrounding the rodlike bulb, as well as a bulb with a light source that emits a narrow or aimed beam, on one face end of the housing. It also has an electrical connection cable and preferably a hangar hook.

The work light of the invention thus performs a dual function; that is, it illuminates a relatively large work field by way of the rodlike light source, and it illuminates a selective work field via the narrow-beam light source. In its usage options, the work light according to the invention is as widely applicable as conventional work lights. As usual, it furnishes an illumination of the area of the particular work field or installation area. Furthermore, it thus takes on the function of the flashlight that would otherwise be carried on one's person. If narrow-beam illumination of a particular location is needed, the bulb with the narrow-beam light source is then turned on in addition or as an alternative. Selected locations can thus be illuminated as needed, especially without glare from a flashlight used for lighting the area. By disposing the additional bulb on the face end of the generally slender light, the light can be aimed very well at the location to be lighted and can also be brought to the vicinity of more poorly accessible locations. The length of the light can advantageously be used to extend its range.

For this purpose, no additional device is needed in the light according to the invention. The narrow-beam light source can be provided in the form of a battery-powered bulb. In an advantageous embodiment of the invention, however, it is also connected to the connection cable, which expediently extends into the housing on the opposite end. Then the otherwise necessary demand for batteries for this application is dispensed with.

Expediently, the rodlike bulb is a fluorescent tube, and the narrow-beam light source is an incandescent bulb. Alternatively, the latter may also be a halogen bulb, for instance. To achieve a higher light yield or in other words better illumination of the work field, the narrow-beam light source is advantageously provided with a reflector.

To prevent shadows when the end-mounted bulb is used, the hangar hook can be mounted on the side, for instance on the end region where the bulb with the narrow-beam illumination is also located.

The electric circuit of the work light according to the invention can be embodied such that the rod like bulb and the additional narrow-beam bulb can each be switched on individually. It can also be provided that they both be turned on simultaneously, or that the narrow-beam bulb can be turned on in addition.

According to the invention, the work light is embodied with a fluorescent bulb and a low-voltage bulb, which are alternated reversibly from a common voltage source. The common voltage source is the alternating voltage network that can be connected via a main circuit connection. First means are provided for converting the alternating means voltage into a direct voltage, and second means are provided for converting the direct voltage into an alternating voltage with a frequency substantially elevated compared to the mains frequency; the voltages for operating the fluorescent tube and the halogen bulb can selectively be derived from the alternating voltage generated. The nucleus of the invention is to supply both bulbs with an alternating voltage, generated in the light, that is derived from the mains voltage and, with a higher frequency, assures that for both the halogen bulb and the fluorescent bulb, it is possible to dispense with heavy, voluminous transformers and chokes. As a result, and because of mains-connected operation, considerable savings in weight can be attained, and the operating time of the light is practically unlimited.

An especially simple and efficient first, preferred embodiment of the work light of the invention is characterized in that the first means include a bridge rectifier, connected to a main circuit connection, and a downstream capacitor for smoothing purposes, that the second means include an oscillator circuit that operates on a load resistor; that the oscillator circuit is constructed in the form of a half bridge circuit that operates with two transistors; that the oscillator circuit is embodied as self-starting and is started up by a break-over diode which is connected to the base of one transistor and is fired by charging a capacitor with the direct voltage; that the load resistor includes the primary winding of a transformer; that to operate the halogen bulb, the halogen bulb is applied to the secondary winding of the transformer; that the load resistor includes a series circuit of the primary winding of the transformer and a capacitor; to operate the fluorescent bulb, the secondary winding of the transformer remains open; and that the load resistor includes a series circuit of the primary winding of the transformer, the two electrodes of the fluorescent bulb, and a capacitor, the capacitor being connected between the two electrodes.

To avoid danger if the halogen bulb is not plugged in or is defective, in accordance with a second preferred embodiment of the invention, within the load resistor comprising the primary winding and the capacitor, a current limiter element is additionally connected in series for the purpose of current limitation.

A further preferred embodiment is distinguished in that to reduce the interfering irradiation to the alternating voltage network at the main circuit connection, an hf choke and/or a capacitor are provided.

Other embodiments are recited in the dependent claims. For instance, the circuit board carrying the circuit can extend as far as the end face of the housing and can act as a mount for the fluorescent bulb and optionally for components of the circuit. Thus various electrical parts are dispensed with, and the work light can be made shorter in length.

BRIEF DESCRIPTION OF THE DRAWINGS

The invention will be described below in further detail in terms of exemplary embodiments and in conjunction with the drawing. The drawing should not be interpreted as limiting of the invention but instead serves to explain and illustrate the invention.

Shown in the drawing are.

DESCRIPTION OF THE PREFERRED EMBODIMENTS

Figure 1:
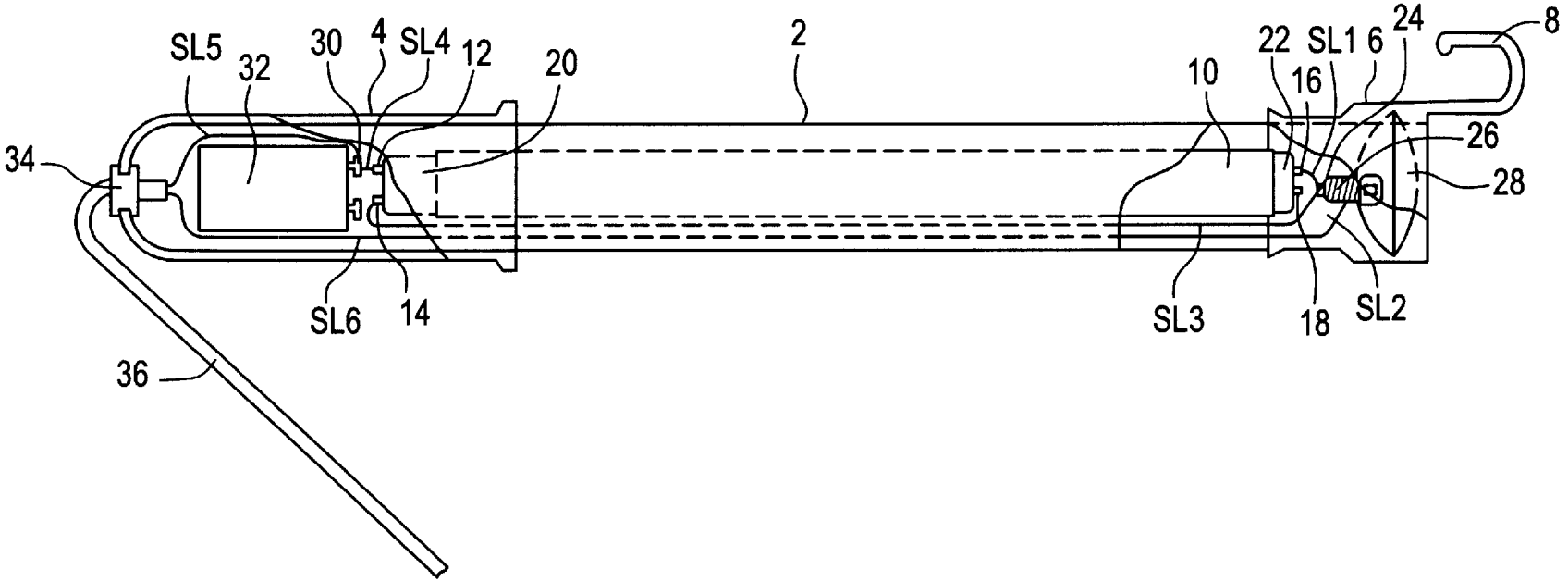
FIG. 1, a partly cutaway side view of a first exemplary embodiment of a work light according to the invention.

The work light shown in FIG. 1 includes a cylindrical, transparent housing or guard tube 12 for instance of plastic, which has a respective cover cap 4, 6 on each of its two ends, the caps likewise being of plastic. A hangar hook is molded onto the cover cap 6 on the right in FIG. 1.

Disposed in the interior of the guard tube 2 is a rodlike fluorescent tube 10, which has connection pins 12, 14, 16, 18 on its ends that are seated in tube mounts 20, 22. The end of the fluorescent tube 10 on the right in FIG. 1 extends along with the associated tube mount into the cover cap 6 and is connected via leads SL1, SL2 to the terminal 24 or socket 26 of a reflector-type incandescent bulb 28.

The end of the fluorescent tube 10 on the left in FIG. 1 also extends into the interior of the cover cap 4. As can be seen, the terminal 14 is connected via a lead SL3 to the terminal 24 of the incandescent bulb 28. The other terminal 12 is connected via a lead SL4 to a terminal 30 of a ballast device 32.

The cover cap 4 is closed on its bottom with a tension relief part 34. A mains cable 36 is guided through the lead through, not shown, of this part, and one lead SL5 of the cable is connected to the terminal 30 of the ballast device 32, while its other lead SL6 is connected to the socket 26 of the incandescent bulb 28. A switch, not shown, is used to turn the work light on and off. In the version shown, both bulbs, that is, the fluorescent tube 10 and the incandescent bulb 28, can be turned on in parallel or simultaneously.

If the lead layout is varied, the circuit can be designed such that the two bulbs can be turned on and off separately, that is, each individually or simultaneously. Alternatively, it can be provided that the incandescent bulb merely be turned on as needed.

Figure 2:
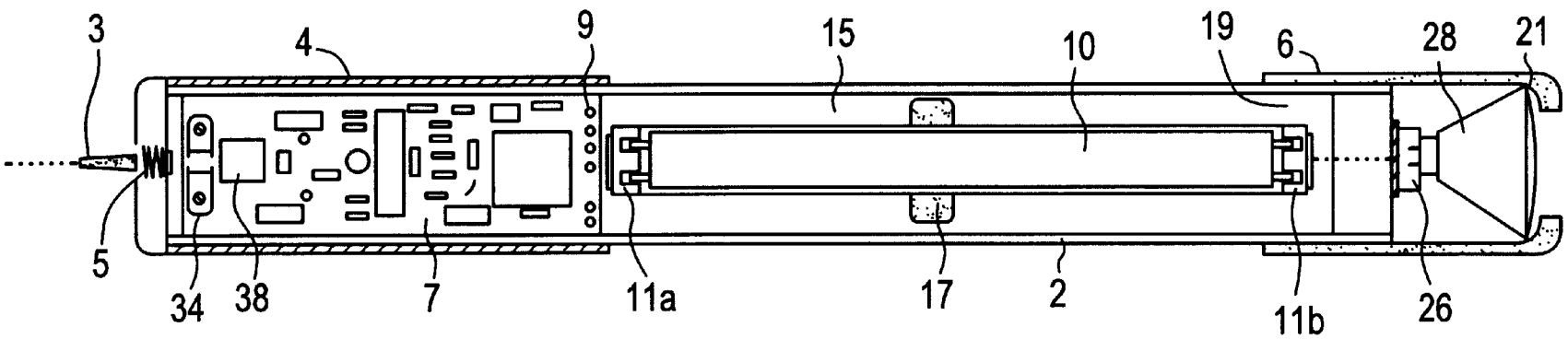
FIG. 2, a fragmentary view of a second exemplary embodiment of a work light according to the invention.

FIG. 2 is a fragmentary view of a second exemplary embodiment of a work light according to the invention. Where the elements have been described identically above, they are designated by the same reference numerals. The cover cap 4 of the guard tube 2 serves as a handgrip and is embodied as a shrink-on hose, and a cable lead through 3 with a kink tube and the tripper for the switch 38, embodied as a pressure switch, with a sealing rubber and compression spring 5 are mounted on the rear end of the handgrip. Located in the interior of the handgrip is a circuit board 7, having the circuit which will be addressed again later in detail as well as connection terminals 9 for the cable to the sockets 11*a*, 11*b* of the fluorescent bulb 10 and the socket 26 of the narrow-beam light embodied as a halogen bulb 28. The sockets 11 and 13 are carried by a curved socket carrier 15, and as a mount for the leads leading to the face-end socket 11*b* of the fluorescent bulb and the socket 26 of the halogen bulb, a guide 17 and leadthrough holes 19 on the face end are provided. A sealing sing 21 is provided between the halogen bulb 28 and the cover cap 6 that acts as the head of the light.

Figure 3:
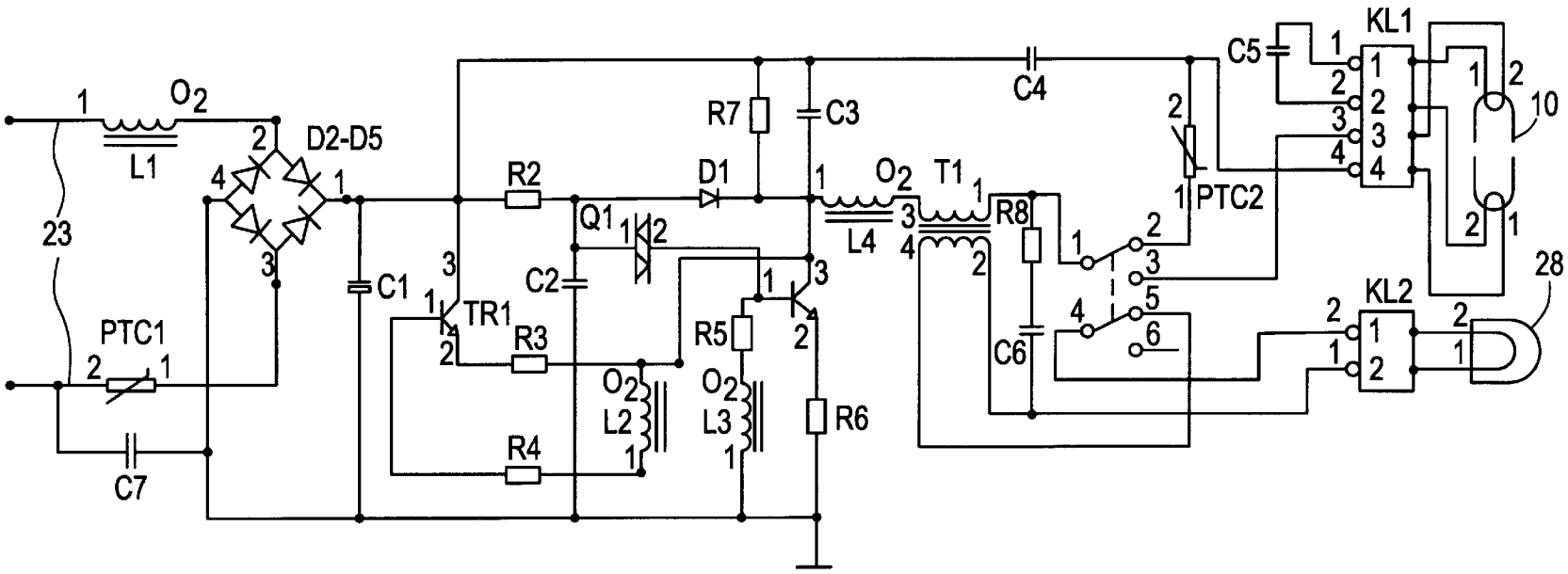
FIG. 3, an exemplary embodiment of circuit for the work light of the invention.

Below, in conjunction with FIG. 3, a preferred exemplary embodiment, which has proved itself in practice, for a circuit of a work light according to the invention is shown. The work light has as its illumination sources a fluorescent bulb 10, with an output of 8 W, for instance, and a halogen bulb 28 with a bulb voltage of 12 V, for instance, and a maximum output of 12 W. The two bulbs are disconnectably connected to the circuit via a multipole terminal strip (plug-in base or the like) KL1 and KL2. The supply of voltage to the circuit or the bulbs 10, 28 is provided from the normal alternating voltage network via a main circuit connection 23.

The alternating means voltage (230 V) applied to the main circuit connection 23 is, without galvanic separation by a means transformer, rectified by a bridge rectifier D2–D5 and then smoothed by a capacitor (for instance, 16 $\mu$F, 350 V). The direct voltage generated is converted by a downstream oscillator circuit into an alternating voltage at a higher frequency (25 kHz or 30 kHz). The oscillator circuit that includes two transistors TR1 and TR2 (for instance of the type known as BULK381D; and that has both the resistors R2, R3, R5, R6 and R7 and the diode D1 and the capacitor C3 is designed as a self-starting half bridge circuit. The resistor R2, the capacitor C2, and the break-over diode (diac) Q1 form the startup circuit for the transistor TR2 and start the oscillator. The windings (inductances) L2, L3 and L4 are wound onto a common ring core and form the feedback of the oscillator.

The fluorescent bulb 10 and the halogen bulb 28 are connected reversibly, via the reversing switch S1, in a load circuit of the oscillator. In fluorescent tube operation—when the reversing switch S1 is in the other switching position, not shown in the drawing—the load resistor is formed by the series circuit of the primary winding, acting as a choke, of a transformer T1; the fluorescent bulb 10; and a series capacitor (capacitor C4). After turn-on and before ignition of the fluorescent bulb 10, the half bridge acts as a series resonant circuit with the ballast inductance of the primary winding of T1 and with a capacitor C5 that is located parallel to the fluorescent bulb 10. At the capacitor C5, the ignition voltage for the fluorescent bulb 10 is then established. As soon as the fluorescent bulb 10 has ignited, the arc voltage and the bulb current regulate themselves to approximately 55 V at approximately 170 mA, for instance. The load conditions for normal operation of the half bridge are thus established.

In the halogen bulb mode (switch position S1 as shown in the drawing), the halogen bulb 28 is connected via S1 to the secondary winding of T1. At the same time, the connection with the fluorescent bulb 10 is disconnected and a connection is made from the capacitor C4 to the transformer T1 via S1. Now the load resistor of the half bridge is formed by C4 and T1. The requisite bulb voltage for the halogen bulb 28 can be drawn from the secondary winding of T1.

The current limiter element PTC2 (for instance of the type known as Polyswitch RXE 0, 30) connected in series with the upper switch contacts of the reversing switch S1 acts as an overload protector in the event that the halogen bulb is not plugged in or is defective. In those cases, the current in the load circuit rises sharply. The PTC2 limits this current to a maximum of 4 mA. The current limiter element is furthermore dimensioned such that in a halogen bulb, it likewise trips higher power than intended because of the higher current in the load circuit.

Since the oscillator circuit oscillates at a relatively high frequency (25 kHz in the fluorescent bulb mode, 30 kHz in operation with the 12 W halogen bulb), a capacitor C7 (for instance, 47 nF) and an HF choke (for instance, 1 mH) are provided on the input side to reduce the interfering irradiation to the mains network.

A capacitor C6, connected to the transformer T1 via a resistor R8, has the effect, particularly in halogen bulb operation, of damping the transformer winding of T1, and as a result a virtually sinusoidal voltage is present at the secondary output. As a result, a substantially reduced interfering radiation emission via the bulb leads is attained.

A semiconductor fuse PTC1 (for instance of the Siemens B59872 type) used at the input acts as a short-circuiting, overload and temperature protector, instead of a fusible link. The inception point is at approximately 115 mA, or a temperature of approximately 80° C. This temperature in the light can be reached only if a short circuit or an overload caused by a defective component is occurring. In both cases, the current rises simultaneously, so that in each case the PTC1 responds before the tripping temperature is reached. As an alternative or in addition, however, a fusible link may also be provided.

Overall, the invention provides a work light for manual work that is compact in design and lightweight. The mains part (rectifier and self-starting oscillator in half bridge circuit) is simple and economical in design.

Figure 4:
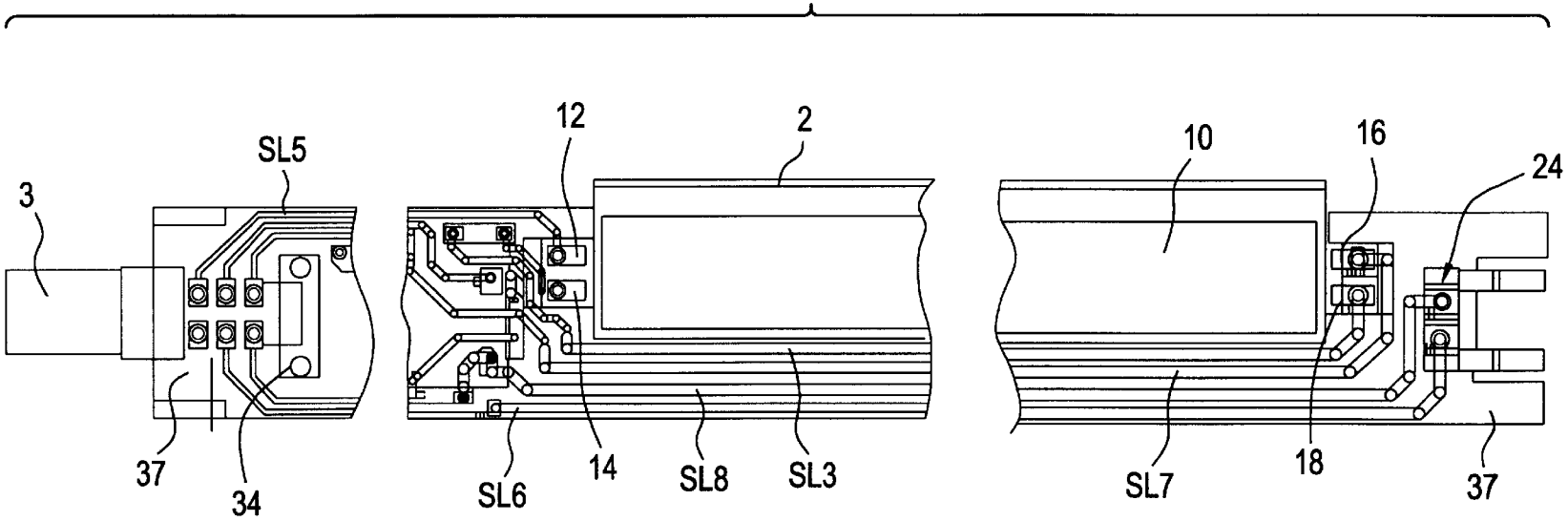
FIG. 4, a schematic view of a third exemplary embodiment of a work light according to the invention, in which the fluorescent bulb is carried by the circuit board.

A further preferred exemplary embodiment of the work light of the invention is shown in FIG. 4. It is distinguished over that described above essentially in the design of the circuit board 37. This circuit board is elongated, compared to the standard version 7, so that it encloses the fluorescent bulb 10 halfway. The fluorescent bulb 10 is retained in the circuit board 37 by means of spring clamps or the like. The lead course (SL3, SL7, SL8) to the face end of the work light is integrated with the circuit board 37, or in other words is laid on it up to the sockets 11*b*, 26 along side the fluorescent bulb 10. Some of the electronic components may be accommodated on the circuit board extension extending along side the fluorescent bulb, thus making it possible for the entire work light to be shorter in length and even easier to handle. Because of the omission of electrical parts (clamping strips, socket carriers for the fluorescent bulb, wiring), which exemplary embodiment is economical.

What is claimed is:

1. A work light, comprising:

a) a generally cylindrical, at least partly transparent housing;

b) a first light source comprising an elongated, rodlike, fluorescent bulb disposed within the housing;

c) a second light source comprising a low voltage, narrow beam bulb disposed within the housing at one end face thereof;

d) means for connection of the first light source to an alternating current source at an electrical main;

e) a hangar hook projecting externally from the housing;

f) means for converting alternating current of a first frequency from the main into direct current;

g) means for converting the direct current into alternating current of a second frequency substantially higher than the first frequency comprising an oscillator circuit that operates on a load resistor, the oscillator circuit being constructed in the form of a half bridge circuit that operates with two transistors, the oscillator circuit being a self-starting circuit which is started up by a break-over diode which is connected to a base of one of said two transistors and is fired by charging a capacitor with the direct current; and h) means for selectively operating the first light source and the second light source with the alternating current of a second frequency.

2. The work light of claim 1, wherein the load resistor includes the primary winding of a transformer.

3. The work light of one of claim 1, additionally comprising a semiconductor fuse acting as a short-circuit, overload and temperature protector disposed at a connection to the electrical main.

4. The work light of claim 1, wherein the oscillator circuit is constructed and arranged to have an operating frequency of more than 20 kHz.

5. The work light of claim 1, additionally comprising means for reducing interfering radiation to the alternating current source at a connection to the electrical main.

6. The work light of claim 5, wherein the means for reducing interfering radiation comprises an HF choke and a capacitor.

7. The work light of claim 2, wherein the second light source is a halogen bulb which is connected to a secondary winding of the transformer, and the load resistor includes a series circuit of the primary winding of the transformer and a capacitor.

8. The work light of claim 7, additionally comprising a current limiter element additionally connected in series within the load resistor comprising the primary winding and the capacitor, for the purpose of current limitation.

9. The work light of claim 8, wherein the fluorescent bulb operates with the secondary winding of the transformer open, and the load resistor includes a series circuit of the primary winding of the transformer, two electrodes of the fluorescent bulb, and a capacitor connected between the two electrodes.

10. The work light of claim 7, additionally comprising a reversing switch to reverse operation between the first light source and the second light source.

11. The work light of claim 1, wherein the circuit is accommodated on a circuit board disposed in a handgrip portion of the housing.

12. The work light of claim 11, wherein the circuit board extends as far as the end face of the housing alongside the rodlike bulb and comprises a mount for this bulb.

13. The work light of claim 12, wherein the circuit board carries components in a region next to the fluorescent bulb.

* * * * *